US006808074B1

(12) United States Patent
Schwartz

(10) Patent No.: US 6,808,074 B1
(45) Date of Patent: Oct. 26, 2004

(54) SHOWCASE SYSTEM AND METHOD

(76) Inventor: Fred G Schwartz, P.O. Box 50161, Columbia, SC (US) 29250

( * ) Notice: Subject to any disclaimer, the term of this patent is extended or adjusted under 35 U.S.C. 154(b) by 0 days.

(21) Appl. No.: 10/243,907

(22) Filed: Sep. 13, 2002

Related U.S. Application Data

(60) Provisional application No. 60/322,174, filed on Sep. 13, 2001.

(51) Int. Cl.[7] ..... B65D 69/00

(52) U.S. Cl. ..... 206/577; 220/4.28; 312/265.3; 312/265.5

(58) Field of Search ..... 206/223, 577, 206/450, 449; 220/4.28, 4.31, 4.32, 4.33; 312/263, 257.1, 265.4, 265.5, 265.6, 265.2, 265.3

(56) References Cited

U.S. PATENT DOCUMENTS

| | | | | |
|---|---|---|---|---|
| 3,044,656 A | * | 7/1962 | Combs et al. | 220/4.28 |
| 3,315,639 A | * | 4/1967 | Close | 220/4.33 |
| 3,784,043 A | * | 1/1974 | Presnick | 220/4.28 |
| 4,002,233 A | | 1/1977 | Page, Jr. | |
| 4,172,623 A | | 10/1979 | Anderson | |
| 5,560,508 A | * | 10/1996 | Hsu | 220/4.31 |
| D393,381 S | | 4/1998 | Santoro | |
| 6,082,843 A | | 7/2000 | Somogyi et al. | |
| 6,209,976 B1 | | 4/2001 | Shear | |

OTHER PUBLICATIONS

Title: Display Cases Date: Apr. 17, 2001 pp.: 6.
Author:Emperor Clock LLC Title: kits–furniture Date: Apr. 17, 2001, pp.: 2.

Author: Allen Display Title: Prominence Series Display Cases Date: Apr. 17, 2001 pp.: 3.

Author: Art Display Essentials Title: Art display essentials: better by choice, better by design Date: Apr. 17, 2001 pp.: 2 printed with following notice: "Copyright 1998–1999 c Art Display Essentials All Rights Reserved".

Author: Display Case Art Title: Football Memorabilia Display Case/ Doll Display Cases Date: Apr. 17, 2001 pp.: 4.

Author: Kaleidospace Title: Engel, Sculptor Date: Apr. 17, 2001 pp.: 2.

* cited by examiner

*Primary Examiner*—Luan K. Bui
(74) *Attorney, Agent, or Firm*—Michael A. Mann; Nexsen PruetAdams Kleemeier, LLC

(57) ABSTRACT

The present invention is a system and method of fabricating showcases in a variety of shapes, sizes, and designs, while allowing both novices, with an interest and skill in arts and crafts (or framing), and professional framers to enjoy the easy-to-construct features of the present invention. The showcase system includes, but is not limited to (1) novel molding pieces that are used in conjuction with (2) standard picture frame pieces, which are themselves used in novel manner, (3) standard glass, mirrored glass, ceramic or other similar materials that can be suitably used to make the showcase walls, (4) standard adhesives, sealants, and/or glass retaining strips, (5) standard matting and/or foam core materials, and/or (6) the use of standard tools, including, but not limited to, a razor knife, stapler, and/or a diamond point attachment tool. A second embodiment of the showcase having a hexagonal shape, is also described.

11 Claims, 9 Drawing Sheets

SHOWCASE SYSTEM AND METHOD

CROSS REFERENCE TO RELATED APPLICATIONS

This application claims the benefit of U.S. Provisional Application No. 60/322,174, filed on Sep. 13, 2001, which is incorporated herein by reference. Applicant claims the priority date benefits of that application.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISK APPENDIX

Not Applicable.

BACKGROUND OF THE INVENTION

The present invention relates to display cases or showcases, and more particularly to a system and method for producing display cases or showcases, such as those used for displaying sculptures, memorabilia and the like.

Display cases or showcases, (the terms "display case" and "showcase," or their plural forms, are interchangeable, and hereinafter they will both be referred to as "showcases"), have been known and available in the trade for a long time, and, generally, they are used to display art, crafts, memorabilia and other similar items. Showcases come in various sizes, shapes, and manners of construction. For example, the U.S. Pat. No. 4,002,233 to Page, Jr. for a knock-down display case kit, which can be used by traveling salesmen to transport their products, describes having alternate sized panels for varying the depth of the case.

As another example, the Collector's Display Cases website shows many examples of display cases of varying sizes and designs. However, all of these cases are pre-made by the manufacturer with specific dimentions.

With this stated, there still remains a need for a showcase fabrication system and method that would allow both novices and experienced framers to build easy-to-construct showcases—without limiting the user of the system and method to any specific size or shape.

SUMMARY OF THE INVENTION

According to its major aspects and briefly recited, the present invention is a system and method of fabricating showcases in a variety of shapes, sizes, and designs, while allowing both novices, with an interest and skill in arts and crafts (or framing), and professional framers to enjoy the easy-to-construct features of the present invention. The showcase system includes, but is not limited to (1) novel molding pieces that are used in conjunction with (2) standard picture frame pieces, which are themselves used in novel manner, (3) standard glass, mirrored glass, ceramic or other similar materials that would be suitable for making the showcase walls, (4) standard adhesives, sealants, and/or glass retaining strips, (5) standard matting and/or foam core materials, and/or (6) the use of standard tools, including, but not limited to, a razor knife, stapler, and/or a diamond point fastening tool.

An important feature of the present invention is that the novel molding pieces, the standard picture frame pieces, and the other associated materials that are used in the present invention, can be made in a variety of lengths that can be cut to size by the showcase fabricator. Additionally, the novel molding pieces and the standard picture frame pieces, can be finished in a wide variety of colors and/or styles to provide desired surface effects. This allows the showcases to be made in a wide variety of shapes and designs, and leads to the advantage of having a great deal of flexibility in meeting the fabricator's or a customer's design requirements for a particular showcase project. Furthermore, this may also give the showcase fabricator the ability to try to match the surrounding furnishings or the decor of the room in which the showcase located.

Another advantage of the system and method is that the use of standard picture frame pieces reduces the cost of the showcase, while at the same time providing the fabricator with the opportunity to use highly decorative trim pieces to complement the showcase without the need of having the trim pieces custom made. (This does not preclude the use of custom made trim pieces, just the necessity of having to do so.)

Still another important feature of the invention, is that the complexity of fabricating the showcase has been substantially eliminated by the use of the novel molding pieces.

These and other features and their advantages will be apparent to those skilled in the art of showcase fabricating and/or picture framing from a careful reading of the Detailed Description of Preferred Embodiments accompanied by the following drawings.

DETAILED DESCRIPTION OF THE INVENTION

Figure 1A:
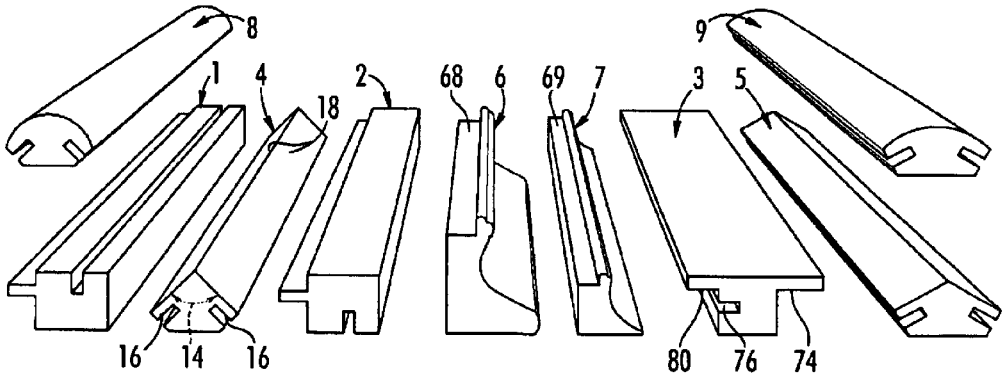
FIG. 1A is a perspective view of the molding pieces and the picture frame pieces used in fabricating a display case, according to a preferred embodiment of the present invention.
Figure 1B:
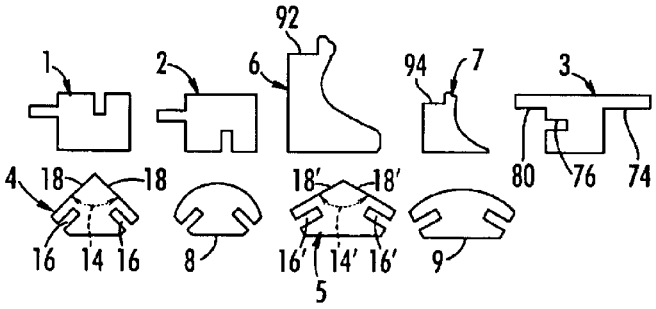
FIG. 1B is an end view of the molding pieces of FIG. 1A.

The terms "molding piece" or "molding pieces" refer to the novel molding pieces 1–5, 8 and 9 and the standard picture frame pieces 6 and 7, as shown in FIGS. 1A and 1B.

Figure 2:
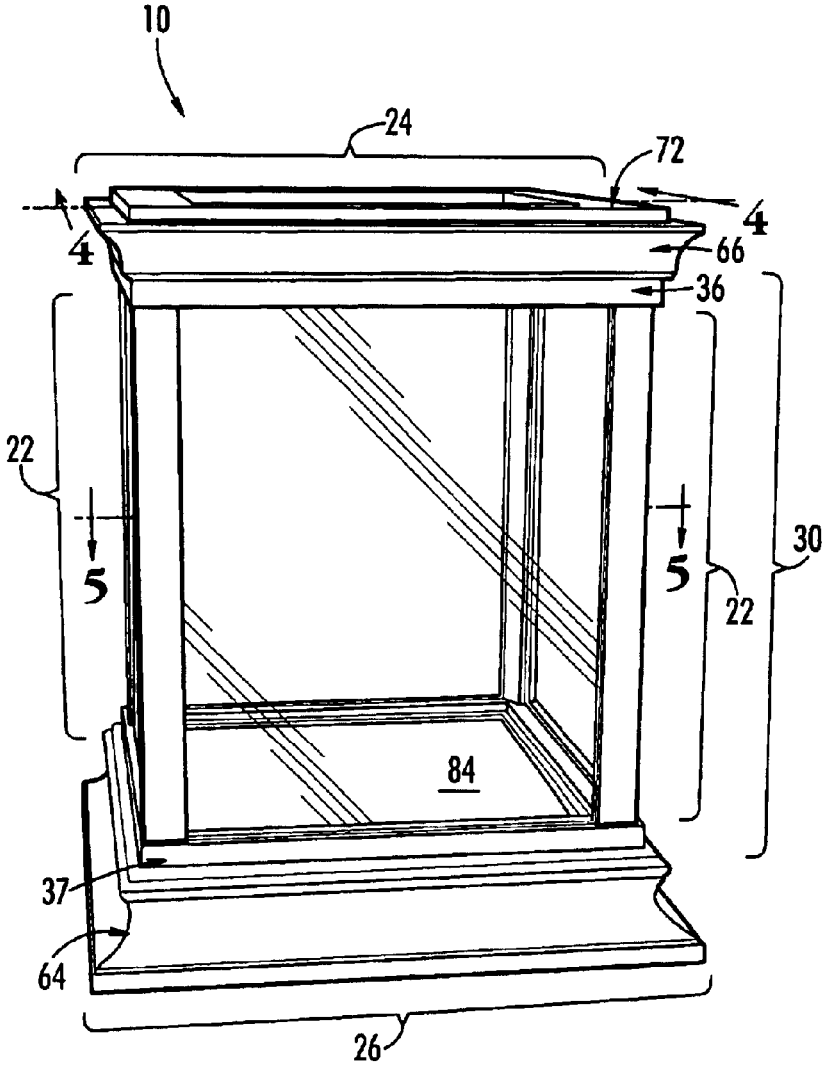
FIG. 2 is a perspective view of the display case, according to a preferred embodiment of the present invention.

Referring now to FIGS. 1A, 1B and 2, preferably, the novel molding pieces are comprised of base molding 1, cap molding 2, lid molding 3, and corner leg molding 4 (or 5, 8 or 9). These novel molding pieces are preferably used in conjunction with standard picture frame molding pieces, which will be used as Base Trim molding 6, and Cap Trim molding 7. The molding pieces 1–9 can be made of wood, metal, plastic, or any other material that would be suitable for fabricating the present invention, and they can be unfinished or finished in any suitable stain, color, or texture, which allows the user of the kit the ability obtain desired surface effects. Additionally, the molding pieces can be pre-cut to standard lengths for particular showcase 10 projects, however, it is preferable that the molding pieces are made of lengths in the range of about one (1') foot to about fourteen (14') feet, and that the fabricator cuts the molding pieces 1–3, 4 (or 5, 8 or 9), 6 and 7 to length, as needed for a particular showcase 10 project, such as the project shown in FIG. 2 for example.

Figure 1C:
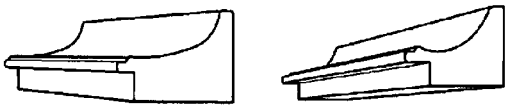
FIG. 1C PRIOR ART
FIG. 1C is a perspective view of two examples of standard picture frame molding showing the prior art orientation of such pieces when used to construct a picture frame.

FIG. 1B shows the end views of the molding pieces and, with the exception of the corner leg molding 4 (or 5, 8 or 9), the tops and bottoms of these end views are generally oriented as they would be in a completed showcase 10. Referring now to FIG. 1C, what is shown in this figure are perspective views of two examples of prior art standard picture frame molding pieces. Comparing the orientation of the standard picture frame molding pieces, as shown in FIG. 1C, with the orientation of the Base Trim molding 6 and Cap Trim molding 7, as shown in FIGS. 1A and 1B, one can readily ascertain that Base Trim molding 6 and Cap Trim molding 7 are rotated 90° in the clockwise direction for use in the present invention.

Figure 3:
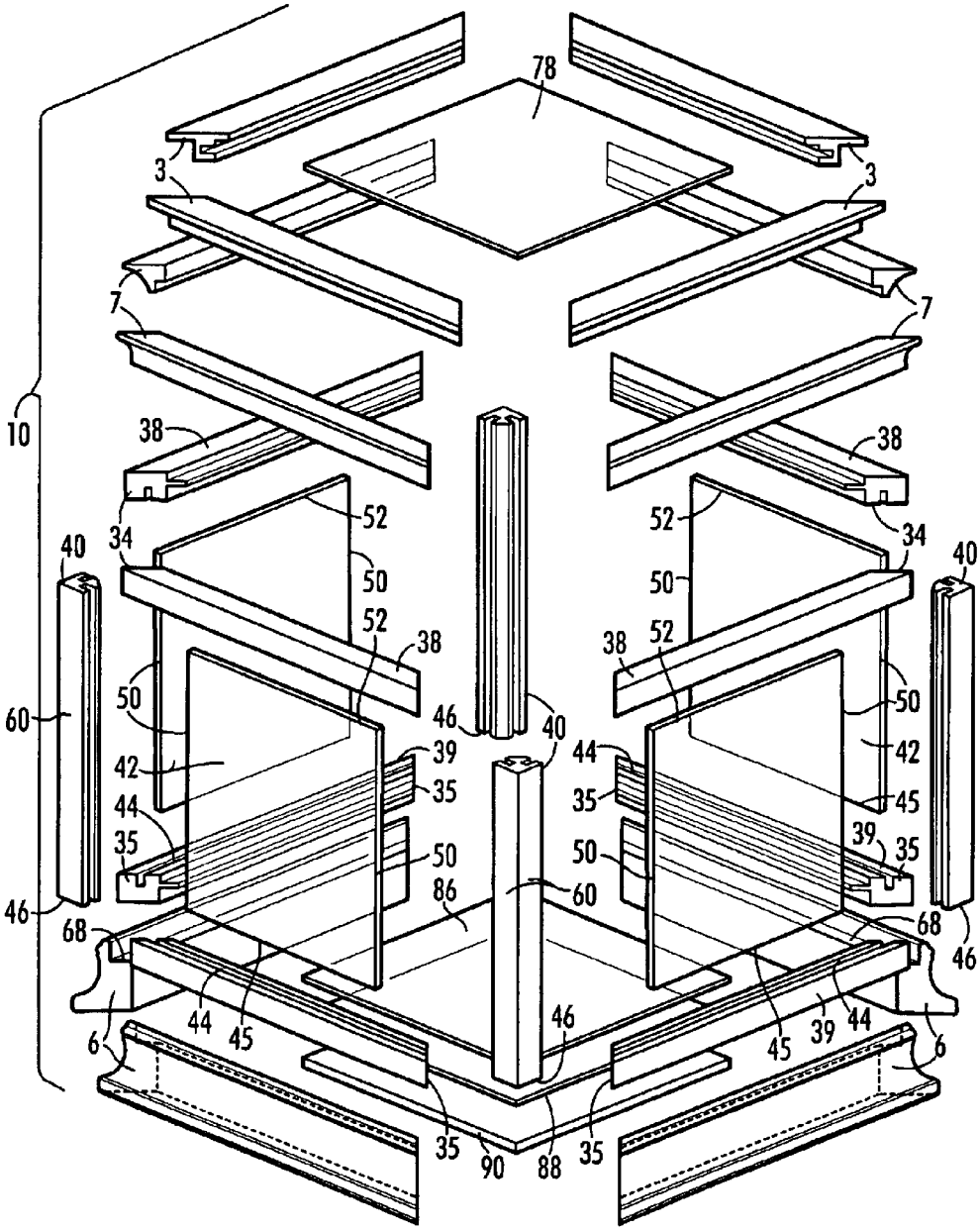
FIG. 3 is an exploded view of the display case of FIG. 2.
Figure 4A:
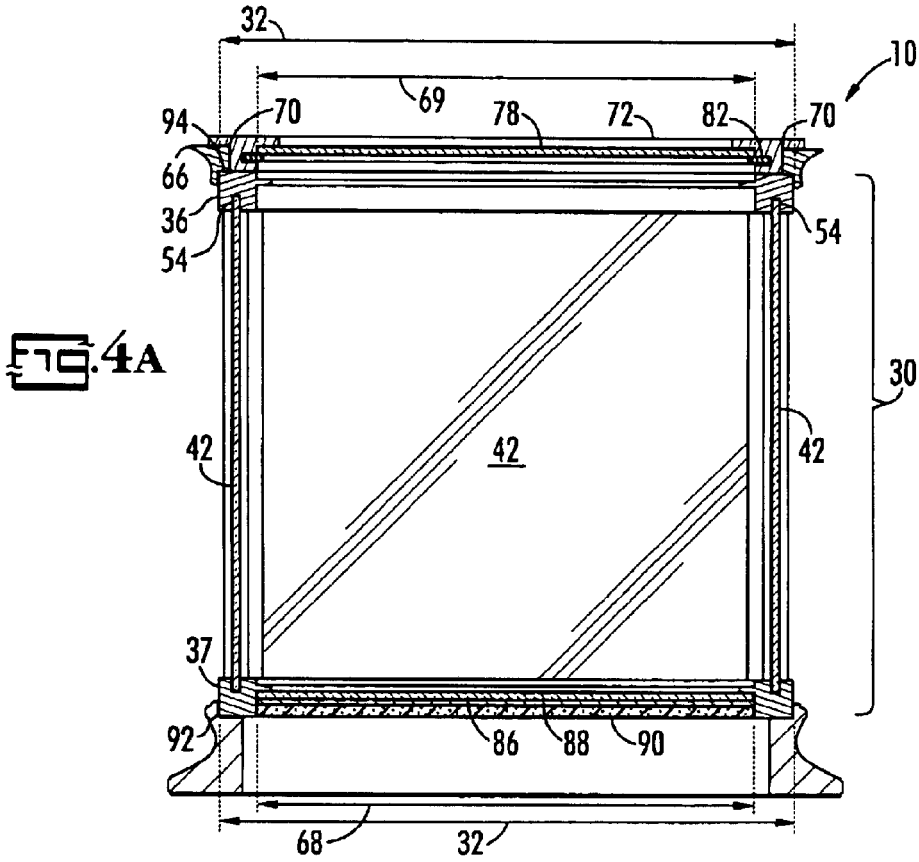
FIG. 4A is a cross section view of the display case of FIG. 2, taken along lines 4—4.
Figure 5:
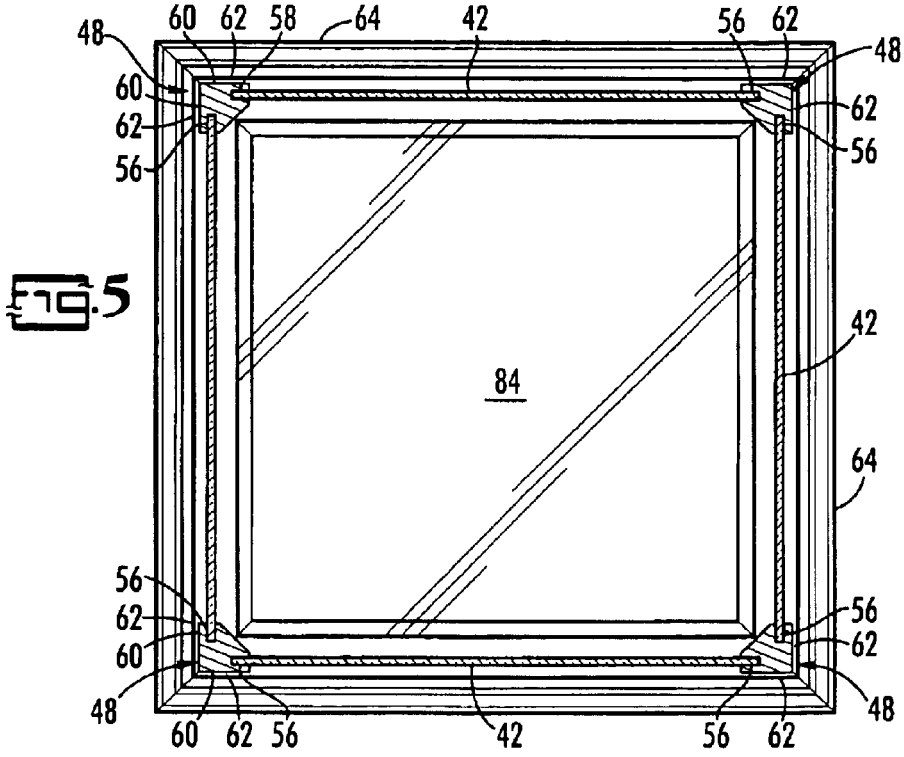
FIG. 5 is a cross section view of the display case of FIG. 2, taken along lines 5—5.
Figure 4B:
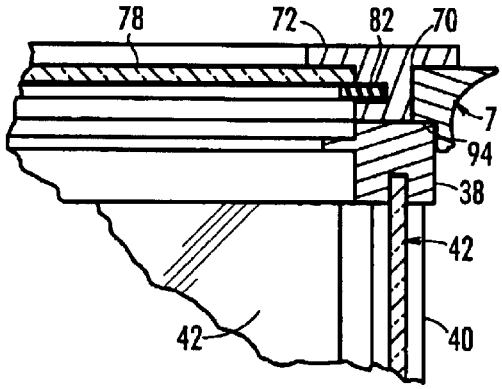
FIG. 4B is a detailed cross section view of one of upper corners of the display case of FIG. 4.
Figure 4C:
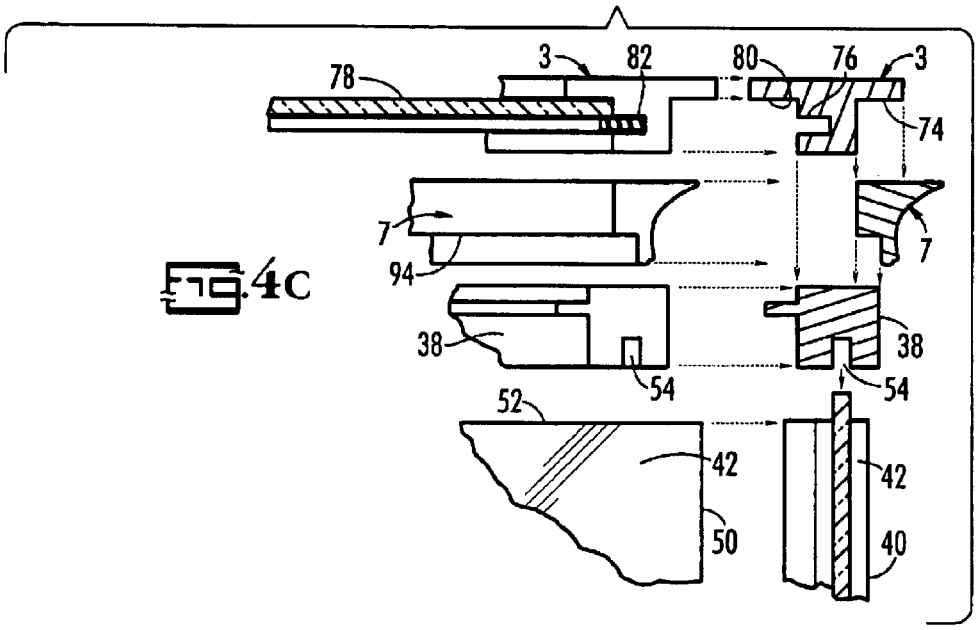
FIG. 4C is an exploded view of FIG. 4B.
Figure 4D:
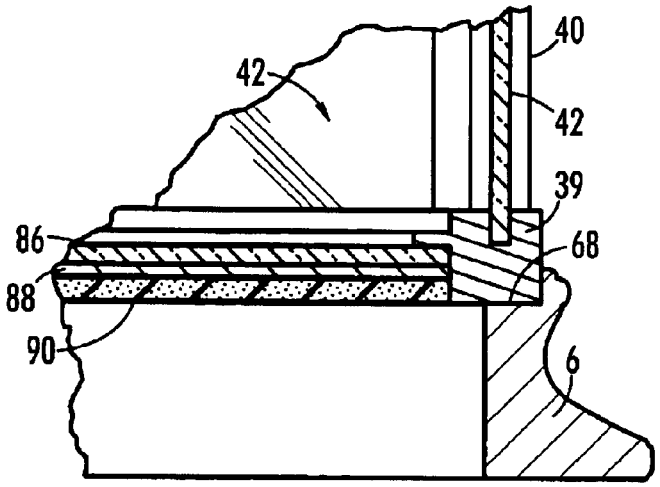
FIG. 4D is a detailed cross section view of one of lower corners of the display case of FIG. 4.
Figure 4E:
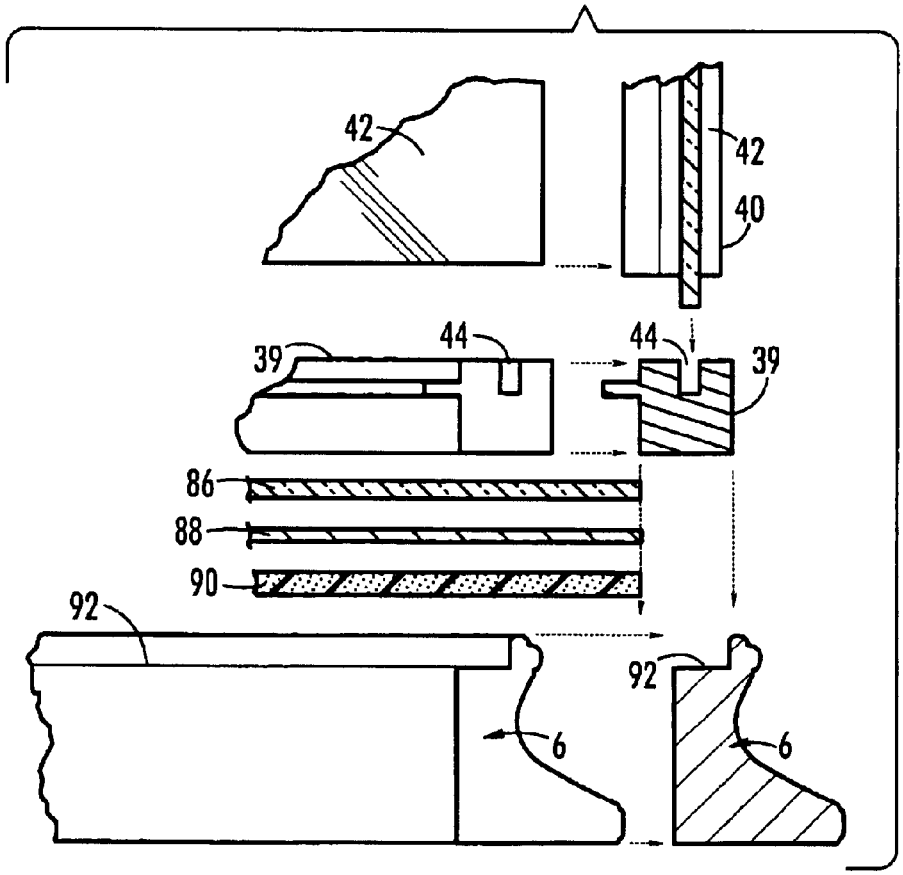
FIG. 4E is an exploded view of FIG. 4D.
Figure 6:
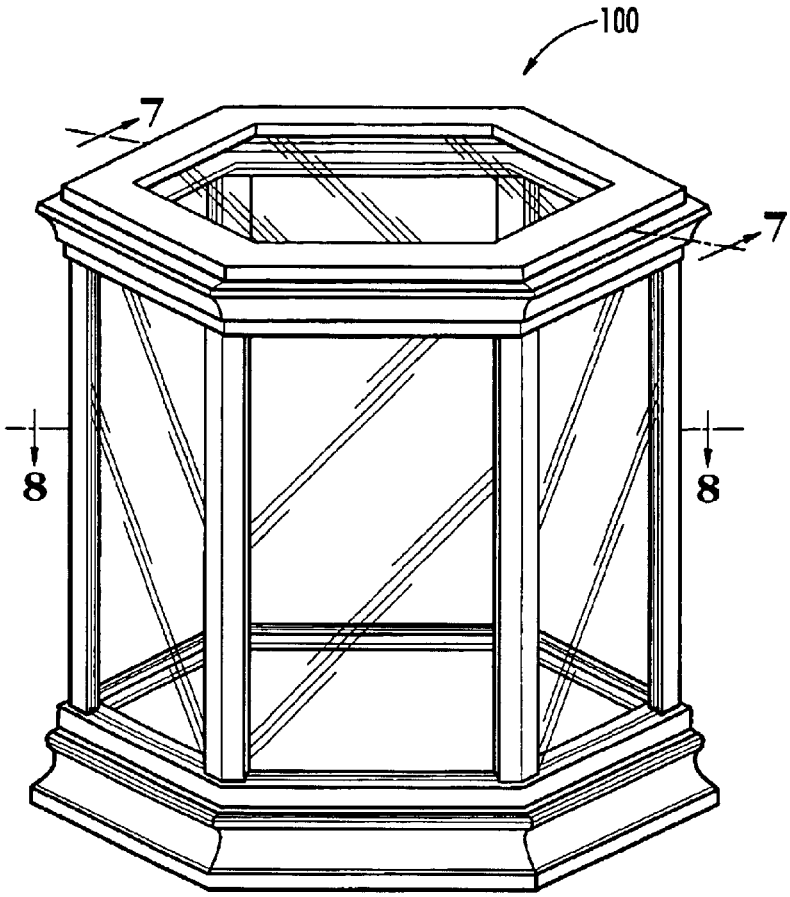
FIG. 6 is a perspective view of the display case, according to another preferred embodiment of the present invention.
Figure 7:
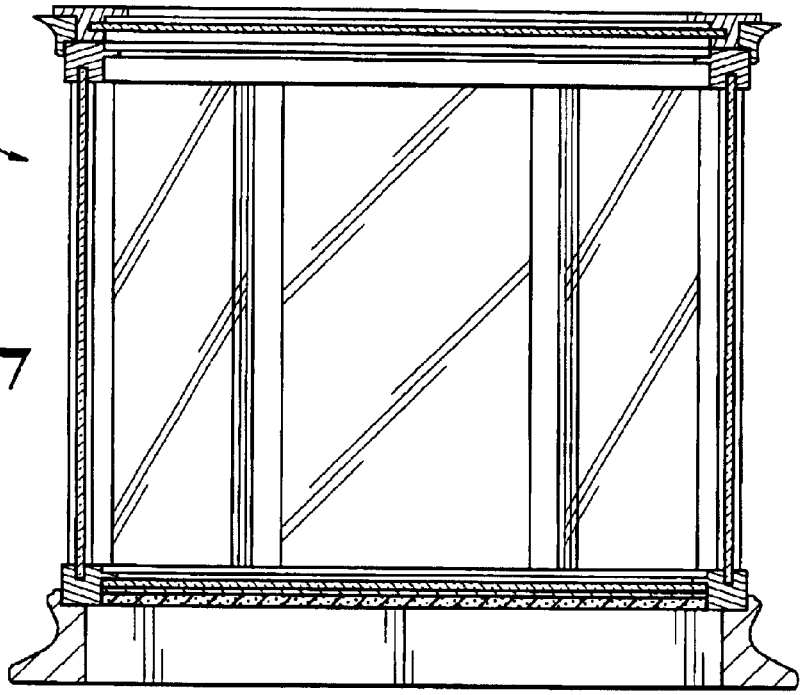
FIG. 7 is a cross section view of the display case of FIG. 6, taken along lines 7—7.
Figure 8:
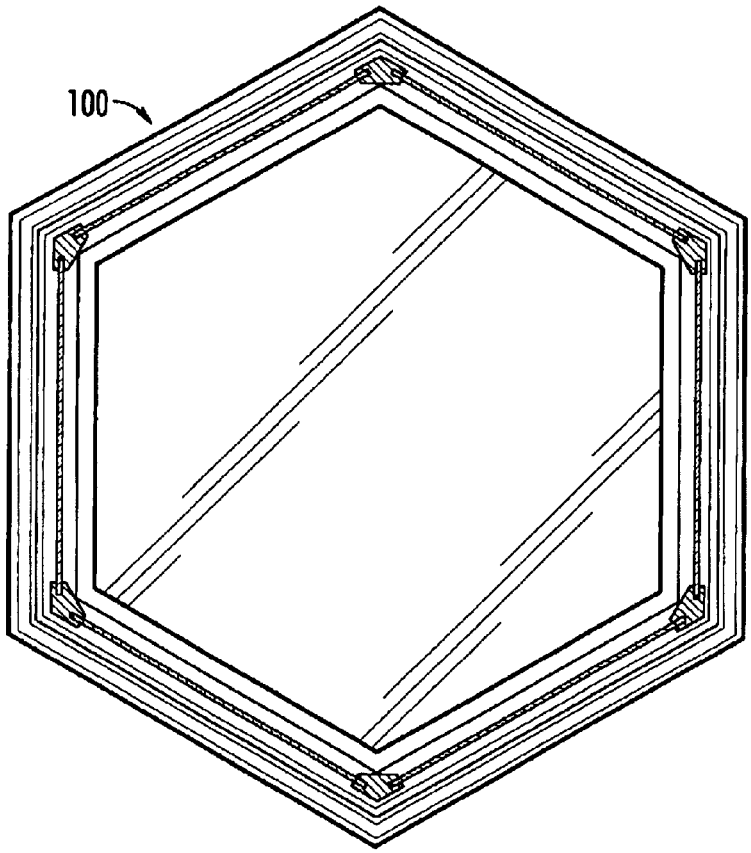
FIG. 8 is a cross section view of the display case of FIG. 6, taken along lines 8—8.

Referring now to FIG. 2, a preferred embodiment of showcase 10 is shown. Preferably, as shown in FIG. 2, the showcase 10 is rectangular in shape. In another embodiment, the showcase 100 is hexagonally shaped, as shown in FIG. 6. However, the showcase 10 (or 100) is not limited to these shapes or designs, e.g., the number of sides can be varied. For example, many other shapes are readily available to the fabricator by ordering the appropriate corner leg(s). As a more specific example, horizontal showcase corner leg molding 5 could be designed so that the inside angle 14' of the grooves 16' and/or the outside edges 18' is 120°, and the angle for making the miter cut on the other molding pieces would be 60°, which would allow a hexagonally shaped showcase 100 to be fabricated, as shown in FIG. 6. As another example of how the showcase components can be varied, the shape of the corner leg molding 4 and/or 5 is not limited to having flat outside edges. Any suitable shape or design can be used including, but not limited to, rounding the outside edges of the corner leg molding 8 and 9. Referring now to FIG. 3, the exploded view of a preferred embodiment of a showcase 10 is shown. To be able to fabricate such a showcase 10, the fabricator would generally have on hand, in stock, or would order from the manufacturer, the molding pieces 14 (or 5, 8 or 9), 6 and 7, in the desired length(s), style(s), and/or finish(es), needed to fabricate the desired showcase 10. Once the molding pieces 1–4 (or 5, 8 or 9), 6 and 7 are available, if necessary, the fabricator will cut the molding pieces 1–4, 6 and 7 to the pre-determined lengths needed for the showcase 10 project. Consequently, the fabricator should have the following molding pieces in order to fabricate the showcase 10: four (4) pieces of base molding 1; four (4) pieces of cap molding 2; four (4) pieces of lid molding 3; four (4) pieces of corner leg molding 4; four (4) pieces of Base Trim molding 6; and four (4) pieces of Cap Trim molding 7. Also on hand, the fabricator should have sufficient amounts of standard glass, and/or mirrored glass, ceramic or other materials that would be suitable for use as part of the showcase's side (or vertical) walls 22, horizontal lid 24, and/or its horizontal base 26. The fabricator should also have available standard adhesives, sealants such as silicone, and/or glass retaining strips, standard matting and/or foam core materials, and/or the use of standard tools, including, but not limited to, a razor knife, stapler, and/or a diamond point fastening tool.

As previously noted, the system and method of the present invention are not limited to fabricating a showcase of any specific configuration, shape, or material. For example, a portion of the side (or vertical) walls 22, can be made of mirrored glass, and/or the horizontal lid 24 and/or the horizontal base 26 can be made using ceramic, plastic, mirrored glass or any other suitable material. In this regard, those skilled in the art of carpentry, woodworking, or any other related art will find that the showcase fabricating system and method can be used in a variety of similar ways.

The following is a description of a method used to fabricate a showcase 10, from the present invention kit, but it should be understood that the best mode for carrying out the invention hereinafter described is by way of illustration and not by way of limitation (for example, the order of the following steps may be varied as appropriate). It is intended that the scope of the present invention includes all modifications that incorporate its principal design features, and that the scope and limitations of the present invention are to be determined by the scope of the appended claims and their equivalents.

Step by Step Showcase Fabrication

Referring to FIGS. 1–8, the following will provide a description of a preferred use of the system and method of the present invention to fabricate a preferred embodiment of the showcase, as shown in FIG. 2. The measurements given in the following description of a preferred embodiment showcase 10 are based on: a Main Showcase Unit 30 having dimensions of about 12 inches in height, about 10 inches in depth, and about 10 inches in width; having grooves formed in the molding pieces of about ⅛th of an inch in width and about ¼th of an inch in depth; and having glass with a thickness of about ⅛th of an inch. However, it should be noted that the measurements given in the following description are illustrative and do not in any way limit the many sizes and shapes available for the showcase 10. Consequently, when other embodiments of the present invention having dimensions that differ from the showcase 10 described herein are being fabricated, the measurements for the component parts for those differing embodiments will have to be adjusted accordingly.

In the following description the molding pieces (1–4, 6 and 7) are made of wood, but the molding pieces (1–4, 6 and 7) can be made of any material suitable for fabricating the showcase including, but not limited to metal or plastic.

Main Showcase Unit

1. To construct the Main Showcase Unit 30, the fabricator, using an outside measurement 32 (see FIG. 4A), will cut four pieces of cap molding 2 and four pieces of base molding 1 to a length of about 9¼ inches. The cap molding ends 34 and the base molding ends 35 will be miter cut at a 45° angle for a rectangular showcase 10 and then the miter cut cap molding 38 will be joined together to form a Cap Frame 36, and the miter cut base molding 39 will be joined together to form a Base Frame 37. Stapling is the preferable method of joining the miter cut molding (38 and 39) pieces together (as appropriate to form the Cap Frame 36 and/or the Base Frame 37); however, any other suitable method can be used for joining the miter cut molding (38 and 39) pieces together including, but not limited to gluing or nailing them together.

2. Using the rectangular showcase corner leg 4 molding, the fabricator will cut four project corner legs 40 to a length of about 9⁄16th inches.

3. Using some of the glass (or other suitable material) acquired for the showcase project, the fabricator will next cut the glass (or other suitable material) into four side (or vertical) wall pieces 42, each having the dimensions of about 8 inches by about 10 inches.

The next three steps allow the fabricator to do a "Trial Fitting." A "Trial Fitting" is not required, but it is preferable that a "Trial Fitting" be performed, especially for the fabricator's first showcase 10 (or for the first showcase 10 of a different dimension and/or shape not previously fabricated by the kit user).

4. (optional) The fabricator should first position the Base Frame 37 on a level horizontal surface so that the Base Frame grooves 44 are accessible from above the Base Frame 37. The fabricator should then stand the bottom edges 45 of the four pieces of the glass side wall pieces 42 in the Base Frame grooves 44. At this point it would be acceptable if any of the glass side wall pieces 42 lean while positioned in the Base Frame grooves 44; however, one or more of the project corner legs 40 can be used to support the glass side wall pieces 42.

5. (optional) If not already done, the fabricator should then place the bottom end 46 of each of the project corner legs 40 onto each of the Base Frame corner tops 48 by slidably inserting each project corner leg 40 between the vertical edges 50, of two of the glass side walls 42, which should be located near the Base Frame corner top 48 that the bottom end 46 of the project corner leg 40 is being placed upon. Once the bottom end 46 of each project corner leg 40 is placed on the respective Base Frame corner top 48, then the project corner legs 40 and the glass side walls 42 can be temporarily held together through the use of rubber bands or by using some other suitable temporary binding method.

6. (optional) The fabricator then places the Cap Frame 36 on top of the glass side walls 42 and aligns the top edges 52 of the glass side walls 42 with the Cap Frame grooves 54.

Once steps 4–6 are completed, the fabricator should check to insure the Cap Frame 36 is resting on the four project corner legs 40 and that the Cap Frame 36 is not being held off any of the project corner legs 40 by the height of any of the glass side walls 42. The fabricator should also check to insure that there is a little play in each of the project corner legs 40, and that the width of each of the glass side walls 42 is not causing any fitting problems for the project corner legs 40.

The fabricator will then make all of the appropriate corrections required, and once everything is fitting together properly, the fabricator will take the Cap Frame 36, the project corner legs 40 and the glass side walls 42 off of the Base Frame 37, and will then proceed to the Main Showcase Unit 30 Assembly.

Main Showcase Unit Assembly

7. To assemble the Main Showcase Unit 30 the fabricator will apply a bead of silicone along the entire length of each Base Frame groove 44, Cap Frame groove 54, and each project corner leg groove 56. The bead of silicone placed in each of the grooves 44, 54, and 56 should not fill the grooves 44, 54, and 56; instead, the amount of silicone in each bead of silicone should just be enough to cover each edge 45, 50, and 52 of the glass when the edges of the glass sidewalls 42 are mated with the grooves 44, 54, and 56.

8. The fabricator should then position the Base Frame 37 on a level horizontal surface so that the Base Frame grooves 44 are accessible from above the Base Frame 37. The fabricator should then stand the bottom edges 45 of the four pieces of the glass side wall pieces 42 in the Base Frame grooves 44. At this point it would be acceptable to have a minimal amount of lean in the glass side walls 42, but the amount of lean should be minimized.

9. The fabricator should then place the bottom end 46 of each of the project corner legs 40 onto each of the Base Frame corner tops 48 by slidably inserting each project corner leg 40 between the vertical edges 50 of two adjacent glass side walls 42 This will (or should) position the bottom end 46 of each project corner leg 40 on a different Base Frame corner top 48. Preferably, the amount of sliding used when installing the project corner legs 40 should be minimized to avoid, as much as possible, the smearing of the silicone in the project corner leg grooves 56. Preferably, one piece of side wall glass 42 is mated with one of the Base Frame grooves 44, and then with one of the project corner leg grooves 56 by using a horizontal sliding action. This same mating procedure is then used for mating the glass side walls 42 with the Base Frame grooves 44 and the project corner leg grooves 56 for the remaining glass side walls 42 and project corner legs 40.

10. The fabricator then places the Cap Frame 36 on top of the glass side walls 42 and aligns the top edges 52 of the glass side walls 42 with the Cap Frame grooves 54, while at the same time insuring that each outside edge 60 of each project corner leg 40 has about ⅛th of an inch inset 62 and that the project corner legs 40, the Base Frame 37 and the Cap Frame 36 are square, i.e., all corners are orthogonal for a rectangular project.

11. The fabricator should then allow the Main Showcase Unit 30 to set, preferably undisturbed, until the silicone has cured. Depending on the silicone directions, this amount of time, for example, may be between three and four hours.

Showcase Trim Assembly

12. While the silicone of the Main Showcase Unit 30 is curing, the fabricator can fabricate the Base Trim Frame 64 using four pieces of Base Trim molding 6, and the Cap Trim Frame 66 using four pieces of Cap Trim molding 7. The ends of each of the molding pieces 6 and 7 are miter cut at a 45° angle so that when two similar molding pieces are joined together their outside edges form a 90° angle, and the measurement of the inside length of the lip 68, for molding piece 6, and the lip 69, of molding piece 7, is about 9⁄32nd inches. After all of the molding pieces 6 and 7 are cut, they are joined together, as appropriate. Stapling of the back or flat sides of the molding pieces 6 and 7 is the preferable method of joining the pieces of the miter cut Base Trim molding 6 together, and the pieces of the miter cut Cap Trim molding 7 together; however, any other suitable method can be used for joining the pieces of the miter cut molding 6 and 7 together including, but not limited to gluing or nailing them together. When stapling is used to join the pieces of the Cap Trim molding 7 together, it is preferable that the staples are kept within about ⅜th of an inch of the inside edges 70. This will allow the Access Lid 72 to cover the staples on the completed showcase 10.

Access Lid and Floor Assembly

13. The fabricator can now fabricate the Access Lid 72 using four pieces of lid molding 3. The ends of each piece of lid molding 3 are miter cut at a 45° angle so that when two pieces of the lid molding are joined together their outside edges form a 90° angle and the measurement of the inside length of the lid molding outside lip 74 for each molding piece 3 is about 8½ inches.

For ease of fabrication, it is preferable that the fabricator position the about ⅛th of an inch by about ¼th of an inch lid molding groove 76 so that it will be located toward the inside of the Access Lid 72 when the pieces of the lid molding 3 are joined together to form the Access Lid 72. Preferably, the joining together of the pieces of the lid molding 3 will be accomplished by stapling the sides of the lid molding 3 that will not normally be seen when the Access Lid 72 is placed on top of the Main Showcase Unit 30. However, any other suitable method can be used for joining the pieces of the miter cut lid molding 3 together including, but not limited to gluing or nailing them together.

Next, the fabricator will cut a piece of lid glass 78 (or other suitable material) to form a square having edges that are about 7¼th inches in length. Preferably, the fabricator will orient the Access Lid 72 so that the lid molding inside lip 80 is located below the lid molding groove 76, i.e., the Access Lid 72 is upside down, and the fabricator will then lay the lid glass 78 on the lid molding inside lip 80. The fabricator will then insert glass retainer strip, which is a commonly used product that is conveniently purchased through frame shop suppliers, into the lid molding groove 76 securing the lid glass 78 (or other suitable material being used) in place, and, if desired, the fabricator can angle cut the glass retainer strip when approaching the inside corners of the Access Lid 72.

14. Preferably, to assemble the floor 84, the fabricator will orient the Main Showcase Unit 30 so that it is upside down. The fabricator will then cut a piece of floor glass 86, a piece of mat board 88, and a piece of foam core 90, each into squares having edges that are about 7⅝th inches in length. The fabricator will then lay the floor glass 86 against the bottom of the Base Frame lip 87, the mat board 88 on top of the floor glass 86, and the foam core 90 on top of the mat board 88, and the fabricator will then secure them all 86, 88, and 90 to the Base Frame 37, preferably, by using diamond point fasteners. When the Main Showcase Unit 30 is placed right-side-up, the order of these pieces 86, 88, and 90 from top to bottom will be floor glass 86, mat board 88, and then the foam core 90. While using the materials just described are preferable, any other suitable material can be used as well, including, but not limited to, plastic, wood, tile, ceramic, porcelain, mirrored glass, and/or etc.

Final Assembly

15. To complete the showcase 10, the fabricator will apply a thin bead of adhesive to the top of the Base Trim Frame inside lip 92, while staying away from the corners so that the adhesive does not ooze up the sides of the Main Showcase Unit 30 when the Main Showcase Unit 30 is placed within the Base Trim Frame 64. The fabricator will then place a thin bead of adhesive to the Cap Trim Frame lip 94, and the fabricator will then set the Cap Trim Frame 66 in place on top of the Main Showcase Unit 30. Afterwards, the fabricator will then be able to place the Access Lid 72 in place on top of the Cap Trim Frame 66 to complete the showcase 10, or a display piece can be positioned inside the showcase 10 prior to placing the Access Lid 72 in place.

Overview of the Method of Assembly

Figure 9:
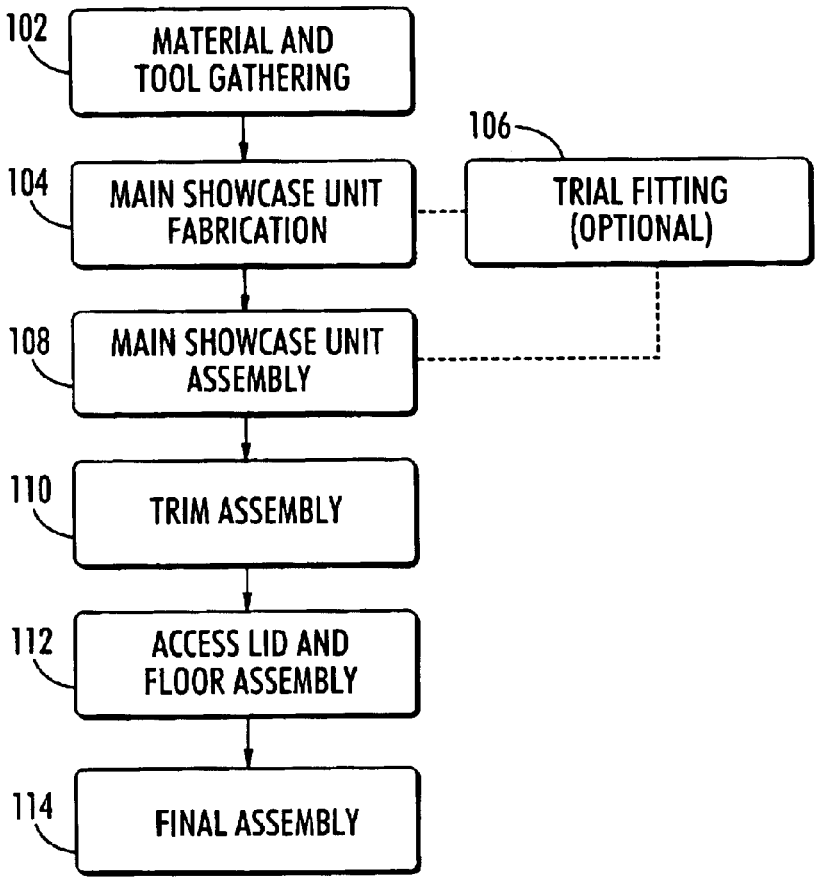
FIG. 9 is a block diagram of the showcase fabricating method, according to a preferred embodiment of the present invention.

Referring now to FIG. 9, an overview of the method used to assemble the showcase 10 is shown in block diagram form. The fabricator begins by Material and Tool Gathering 102 to ensure that the fabricator has the parts and the tools necessary for constructing the showcase 10. Next, the Main Showcase Unit Fabrication 104 is performed by the fabricator, which may include a Trial Fitting 106. Afterwards, the fabricator performs the steps of: Main Showcase Unit Assembly 108; Trim Assembly 110; Access Lid and Floor Assembly 112; and finishes with the Final Assembly 114 step to complete the showcase 10.

While the preferred embodiments and the best mode of the present invention are described herein, it should be understood that the best mode for carrying out the invention as described herein was by way of illustration and not by way of limitation. It is intended that the scope of the present invention includes all modifications that incorporate its principal design features, and that the scope and limitations of the present invention are also to be determined by the scope of the appended claims and their equivalents.

What is claimed is:

1. A kit for forming a display case, said display case for use with panels and picture frame molding, said kit comprising:

base members;

leg members;

cap members, wherein each of said base members and said cap members have a groove and a lip formed thereon, and each of said leg members have a pair of grooves formed thereon, so that when said base members, said cap members and said leg members are joined together said base members, said cap members and said leg members form an enclosure, wherein said base members, said cap members and said leg members can receive wall panels in said grooves, said base members can receive at least one floor panel on said base member's lips, and said cap members may carry a lid;

a base trim frame fabricated from picture frame molding, said base trim frame for carrying said enclosure; and a cap trim frame fabricated from picture frame molding, said cap trim frame for receiving said enclosure, wherein said base trim frame and said cap trim frame, when used with said enclosure for providing both aesthetic and structural support benefits.

2. The kit as recited in claim 1, further comprising lid members, said lid members designed to be joined together to form said lid, each of said lid members having a groove, an outer lip and an inner lip formed thereon, wherein said lid can receive a lid panel on said inner lip, and wherein a means can be carried by each of said lid member's grooves for securing said lid panel to said inner lip.

3. The kit as recited in claim 1, wherein said wall panels are made of a transparent material.

4. The kit as recited in claim 1, wherein said wall panels and said at least one floor panel are made from a material selected from the group consisting of glass, mirrored glass, plastic, metal, wood and ceramic.

5. The kit as recited in claim 1, wherein at least one of said wall panels is made of an opaque material selected from a group consisting of mirrored glass, ceramic, porcelain, metal, wood and plastic.

6. The kit as recited in claim 1, wherein at least one of said at least one floor panel is made from foam core material.

7. The kit as recited in claim 1, wherein said base members, said cap members and said leg members are made to lengths in the range of about 1 foot to about 14 feet and can be cut by a user to the lengths needed by said user.

8. The kit as recited in claim 1, wherein said picture frame molding is off-the-shelf picture frame molding, and wherein, based on the standard orientation of off-the-shelf picture frame molding when used to form a standard picture frame, said picture frame molding is rotated ninety (90°) degrees around its longitudinal axis when used with said enclosure, and wherein said off-the-shelf picture frame molding, if obtained in an unfinished condition, can be finished by a user to achieve a desired surface effect.

9. The kit as recited in claim 2, wherein said lid members, said leg members, said base members and said cap members can be finished to achieve a desired surface effect.

10. A kit for forming a display case, said display case for use with panels and picture frame molding, said kit comprising:

base members;

leg members;

cap members;

side wall panels;

at least one horizontal flooring panel;

a lid panel; and lid members, wherein each of said base members, said lid members and said cap members have a groove and a lip formed thereon, and each of said leg members have a pair of grooves formed thereon, so that when said base members, said cap members, said lid members and said leg members are joined together said base members, said cap members, said lid members and said leg members form an enclosure, wherein said base members, said leg members and said cap members can receive said side wall panels in said grooves forming vertical faces on said enclosure, said base members can receive said at least one horizontal panel on said base member's lips forming a floor to carry an item to be displayed, said cap members can receive a lid formed by said lid members, and said lid can receive said lid panel on said lid member's lips forming a top face on said enclosure, wherein said groove on said lid members is used for receiving means for securing said lid panel to said lid, and wherein said enclosure can be trimmed with picture frame molding.

11. A kit for forming a display case, said display case for use with panels and picture frame molding, said kit comprising:

base members;

leg members; cap members, wherein each of said base members and said cap members have a groove and a lip formed thereon, and each of said leg members have a pair of grooves formed thereon, so that when said base members, said cap members and said leg members are joined together said base members, said cap members and said leg members form an enclosure, wherein said base members, said cap members and said leg members can receive wall panels in said grooves and said base members can receive at least one floor panel on said base member's, lips, and said cap members may carry a lid; and lid members, said lid members designed to be joined together to form said lid, each of said lid members having a groove, an outer lip and an inner lip formed thereon, wherein said lid can receive a lid panel on said inner lip, and wherein means can be carried by each of said lid member's grooves for securing said lid panel to said inner lip.

* * * * *